US009753472B2

(12) United States Patent
Price et al.

(10) Patent No.: US 9,753,472 B2
(45) Date of Patent: Sep. 5, 2017

(54) LDO LIFE EXTENSION CIRCUITRY

(71) Applicant: QUALCOMM Incorporated, San Diego, CA (US)

(72) Inventors: Burt Lee Price, Apex, NC (US); Dhaval Rajeshbhai Shah, Raleigh, NC (US); Jonathan Liu, Folsom, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/827,239

(22) Filed: Aug. 14, 2015

(65) Prior Publication Data

US 2017/0045901 A1 Feb. 16, 2017

(51) Int. Cl.

| | |
|---|---|
| ***G05F 1/00*** | (2006.01) |
| ***G05F 1/56*** | (2006.01) |
| ***G05F 1/575*** | (2006.01) |
| ***G05F 1/565*** | (2006.01) |

(52) U.S. Cl.

CPC ..... *G05F 1/56* (2013.01); *G05F 1/565* (2013.01); *G05F 1/575* (2013.01)

(58) Field of Classification Search

CPC ..... G05F 1/575; G05F 1/56; G05F 1/573
USPC ..... 323/273–281
See application file for complete search history.

(56) References Cited

U.S. PATENT DOCUMENTS

| | | | | |
|---|---|---|---|---|
| 7,545,128 | B2 * | 6/2009 | Nakajikkoku | H03F 3/45183 323/281 |
| 8,148,960 | B2 * | 4/2012 | Tonomura | G05F 1/569 323/273 |
| 8,493,043 | B2 | 7/2013 | Le et al. | |
| 8,564,262 | B2 | 10/2013 | Bose et al. | |
| 8,975,882 | B2 | 3/2015 | Li | |
| 8,981,745 | B2 | 3/2015 | Price et al. | |
| 2001/0011886 | A1 * | 8/2001 | Kobayashi | G05F 1/465 323/281 |
| 2005/0073286 | A1 * | 4/2005 | Ke | G05F 1/575 323/280 |
| 2013/0049721 | A1 | 2/2013 | Lo et al. | |

FOREIGN PATENT DOCUMENTS

EP 2320296 A1 5/2011

OTHER PUBLICATIONS

International Search Report and Written Opinion—PCT/US2016/045827—ISA/EPO—Oct. 25, 2016.

* cited by examiner

*Primary Examiner* — Nguyen Tran
(74) *Attorney, Agent, or Firm* — MG-IP Law, P.C.

(57) ABSTRACT

Systems and methods relate to extending life of a low-dropout (LDO) voltage regulator. A differential amplifier of the LDO voltage regulator includes switches that can be selectively turned on or off. When the LDO voltage regulator is bypassed or turned off (or not active), a first switch is turned on to selectively couple gates of a first input transistor and a second input transistor of the differential amplifier, to maintain the gates at a same voltage. The first switch is turned off to decouple the gates when the LDO voltage regulator is active. Further, a second switch can be turned on or off to selectively couple or decouple, respectively, the gate of the second input transistor to an output voltage of the LDO voltage regulator, based on whether the LDO voltage regulator is active or not active, respectively.

12 Claims, 5 Drawing Sheets

LDO LIFE EXTENSION CIRCUITRY

FIELD OF DISCLOSURE

Disclosed aspects relate to operational or differential amplifiers. More specifically, exemplary aspects relate to life extension of low dropout (LDO) voltage regulators comprising differential amplifiers.

BACKGROUND

Operational amplifiers such as differential amplifiers find applications in integrated circuits where voltage regulation is desired. For example, low dropout (LDO) voltage regulators may be designed using operational amplifiers and used for supplying a regulated voltage (which may be lower than a maximum supply voltage) to selected sections or components of an integrated circuit. An LDO voltage regulator may be a direct current (DC) linear voltage regulator that can operate with a very low dropout, where "dropout" or "dropout voltage" refers to the difference between an input voltage (e.g., maximum supply voltage received from a power supply rail) and the regulated output voltage.

LDO voltage regulators may be deployed, for example, in processing systems comprising one or more processing cores and/or one or more subsystems. Each core or subsystem may be configured for processing speeds specific to that core or subsystem, and so, there may be different power metrics for the various cores, subsystems, etc., of the processing system. For example, a core which is to be operated at its maximum performance level or highest operating frequency be connected to the maximum voltage supply, whereas the voltage supply can be reduced for a lower performance level/operating frequency. LDO voltage regulators may be used to supply a lower voltage (also referred to as a regulated voltage, herein) that is less than the maximum supply voltage to some cores or subsystems based on their individual power/voltage levels.

FIG. 1 illustrates processing system 100, shown to comprise multiple processing cores designated as cores 102*a-d* to illustrate aspects of different power/supply voltage levels across the various cores 102*a-d* (while it will be understood that a similar discussion is applicable to various subsystems of a core, such as a display, a modem, an audio controller, etc.) As shown, corresponding power head switches or block head switches (BHS) 106*a-d* are provided for cores 102*a-d*. BHS 106*a-d* may comprise one or more pull-up transistors or p-channel metal oxide semiconductor (PMOS) devices (not explicitly shown). When a BHS is turned on, it means the PMOS devices of the BHS are closed or turned on, causing positive maximum supply voltage Vdd 108 (which may be derived from an external voltage supply rail or "Vdd_ext") to be supplied to the respective cores 102*a-d*. BHSs 106*a-d* can be selectively closed when corresponding cores 102*a-d* are to be operated at their maximum performance/frequency. When any BHS 106*a-d* is closed (or turned on), a corresponding LDO voltage regulator (or simply, "LDO" in this disclosure) 104*a-d* may be bypassed or put in "bypass" mode. Where a lower performance/frequency is acceptable for one or more cores 102*a-d*, their corresponding BHSs 106*a-d* are opened or turned off, and LDOs 104*a-d* are used to provide lower, regulated voltages to those cores 102*a-d*.

A power controller such as power management integrated circuit (or "PMIC," not specifically shown) can be integrated on the same chip as processing system 100 or located off-chip. The PMIC can be configured to control BHSs 106*a-d* and LDOs 104*a-d*, to supply lower voltages to cores 102*a-d* which are not operated at their highest performance/frequency. For example, the PMIC can turn on one or more BHSs 106*a-d* while placing corresponding LDOs 104*a-d* in bypass mode to provide maximum supply voltage; or turn off one or more BHSs 106*a-d* while utilizing corresponding LDOs 104*a-d* to supply lower voltage to corresponding cores 104*a-d* respectively.

LDOs 104*a-d* are conventionally designed with operational amplifiers or differential amplifiers, wherein, in the bypass mode, gates of input transistors of the differential amplifiers can be driven to disparate voltages. Over prolonged use, the disparate voltages can cause different levels of hot electrons to be injected into the gates of the complementary input transistors, which can lead to undesirable voltage offsets to appear between the gates of the input transistors. The offset voltages can lead to degraded performance of the LDOs 104*a-d*, thus reducing the life span of the LDOs. Accordingly, there is a corresponding need to extend the life of LDOs by mitigating or avoiding the detrimental effects of disparate voltages in the bypass mode of LDOs.

SUMMARY

Exemplary aspects of are directed to systems and methods for extending life of a low-dropout (LDO) voltage regulator comprising a differential amplifier. An exemplary LDO voltage regulator includes switches (e.g., transmission gates) that can be selectively turned on or off. When the LDO voltage regulator is bypassed or turned off (or not active), a first switch is turned on to selectively couple a gate of a first input transistor of a differential amplifier of the LDO voltage regulator and a gate of a second input transistor of the differential amplifier, in order to maintain the gates of the first and second input transistors at the same potential, which mitigates different levels of hot electron injections into the gates and undesirable voltage offsets, thus extending life of the LDO voltage regulator. The first switch is turned off to decouple the gates when the LDO voltage regulator is active. Further, a second switch can selectively couple or decouple the gate of the second input transistor and an output voltage of the LDO voltage regulator when the LDO voltage regulator is active or not active, respectively.

An exemplary aspect is directed to low-dropout (LDO) voltage regulator comprising a differential amplifier comprising a first input transistor and a second input transistor. A first switch to selectively couple a gate of the first input transistor and a gate of the second input transistor when the LDO voltage regulator is not active. The first switch may be further configured to decouple the gate of the first input transistor and the gate of the second input transistor when the LDO voltage regulator is active.

Another exemplary aspect is directed to a method of extending life of a low-dropout (LDO) voltage regulator, the method comprising: turning on a first switch to selectively couple a gate of a first input transistor of a differential amplifier of the LDO voltage regulator and a gate of a second input transistor of the differential amplifier, when the LDO voltage regulator is not active. The method can further include turning off the first switch to decouple the gate of the first input transistor and the gate of the second input transistor when the LDO voltage regulator is active.

Yet another exemplary aspect is directed to an apparatus comprising means for amplifying, and means for selectively coupling a gate of a first input transistor of the means for amplifying and a gate of a second input transistor of the means for amplifying, when the means for amplifying is not active.

BRIEF DESCRIPTION OF THE DRAWINGS

The accompanying drawings are presented to aid in the description of aspects of the invention and are provided solely for illustration of the aspects and not limitation thereof.

DETAILED DESCRIPTION

Aspects of the invention are disclosed in the following description and related drawings directed to specific aspects of the invention. Alternate aspects may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any aspect described herein as "exemplary" is not necessarily to be construed as preferred or advantageous over other aspects. Likewise, the term "aspects of the invention" does not require that all aspects of the invention include the discussed feature, advantage or mode of operation.

The terminology used herein is for the purpose of describing particular aspects only and is not intended to be limiting of aspects of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Further, many aspects are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the aspects described herein, the corresponding form of any such aspects may be described herein as, for example, "logic configured to" perform the described action.

Exemplary aspects of this disclosure are directed to avoiding the aforementioned drawbacks of conventional LDOs in order to extend the lifespan of exemplary LDOs. It will be appreciated that while a detailed description is provided herein for extending the lifespan of LDOs, exemplary aspects may also be applicable to extending lifespan of any operational amplifier, and as such, disclosed aspects are not limited to LDOs.

Figure 2:
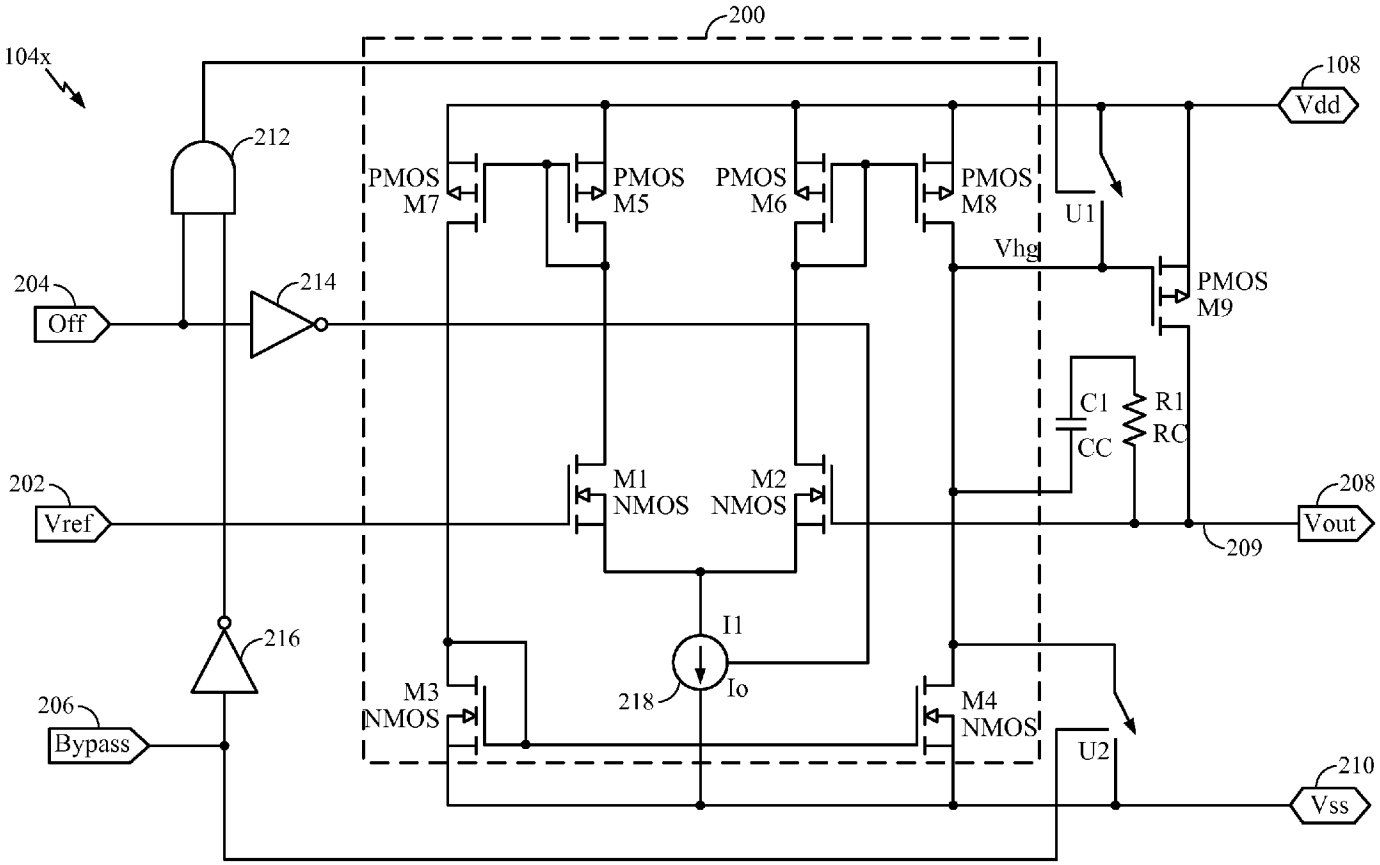
FIG. 2 illustrates a conventional LDO voltage regulator.

Before a detailed explanation of exemplary techniques, a circuit schematic of a conventional LDO will first be provided. With reference to FIG. 2 a schematic diagram of a conventional LDO voltage regulator LDO 104*x* (which may be any of LDOs 104*a-d* described previously), is illustrated. As shown, LDO 104*x* includes differential amplifier 200 and a PMOS pass gate M9 that controllably feeds a regulator output, labeled Vout 208, from an external power rail or supply rail Vdd 108. Differential amplifier 200 operates by receiving at one of its differential inputs a reference voltage, Vref 202 and, at the other of its inputs, a feedback of Vout 208 over feedback path 209. Differential amplifier 200 generates, based on the difference of Vref 202 and Vout 208 (fed back), a pass gate control signal, or voltage, labeled Vhg. The feedback configuration of differential amplifier 200 forces Vhg to a value at which the resistance of pass gate M9, and resulting voltage drop, provide Vout 208 as approximately equal to Vref 202.

In FIG. 2, differential amplifier 200 may be formed of two parallel branches extending from Vdd 108 to a common node which is coupled to current source 218. A first branch of the two branches comprises internal load transistor M5 in series with first input transistor M1, and the second branch comprises internal load transistor M6 in series with second input transistor M2. Internal load transistors M5 and M6 may be pull-up transistors (e.g., p-channel metal oxide semiconductor or "PMOS" transistors) and first and second input transistors may be pull-down transistors (e.g., n-channel metal oxide semiconductor or "NMOS" transistors). Current source 218 sets the bias of the first and second input transistors M1 and M2. The gate of the first input transistor M1 of differential amplifier 200 receives Vref 202 while the gate of the second input transistor M2 receives Vout 208 through feedback path 209. Differential amplifier 200 can also include pull-up or PMOS transistors M7 and M8 and pull-down or NMOS transistors M3 and M4 for increasing gain of differential amplifier 200. Resistances R1/Rc and capacitances C1/CC are also provided as a compensation path, to place a zero in the frequency response of the feedback loop, in order to compensate for loop characteristics of differential amplifier 200. Further details regarding the configuration and operation of differential amplifier 200 will be recognized by one skilled in the art, and therefore the following discussion will focus on aspects of LDO 104*x* which are relevant to this disclosure.

As previously mentioned, output voltage Vout 208 may be supplied as the regulated voltage to cores (e.g., cores 102*a-d* of FIG. 1) when LDO 104*x* (e.g., corresponding LDOs 104*a-d*) is active (i.e., not turned off or bypassed). PMOS transistor M9 may be an output transistor coupled between Vdd 108 and Vout 208. Under ideal operating conditions, as will be understood by one skilled in the art, when LDO 104*x* is in a normal or active mode, differential amplifier 200 is expected to cause Vout 208 to be equal to Vref 202, where Vref 202 is the expected value of the regulated output voltage 208 which appears at the load (e.g. cores 102*a-d* or other subsystems for which an LDO voltage regulator is used to provide regulated voltage). However, non-idealities which will be further explained below may cause voltage offsets to be created in LDO 104*x*, resulting in Vout 208 deviating from the expected value of Vref 202.

The other modes of operation of LDO 104*x* will now be explained. LDO 104*x* receives control signals shown as off 204 and bypass 206. Inverters 214 and 216 provide inverted versions of off 204 and bypass 206 respectively. When LDO 104*x* needs to be turned off, control signal off 204 is high, and bypass 206 is low. This causes the output of AND gate 212, fed by off 204 and inverted bypass 206, to be high. Correspondingly, switch U1 is shorted or closed, which causes the gate of output PMOS transistor M9 to be connected to Vdd 108, thus turning off output PMOS transistor M9.

If, on the other hand, LDO 104*x* is to be placed in bypass mode, bypass 206 is high. Regardless of the value of off 204, the output of AND gate 212 is low, causing switch U1 to be open. Further, bypass 206 being high closes switch U2. The combination of switch U1 being open and switch U2 being closed, pulls the gate terminal of output PMOS transistor M9 low or to the value of negative supply voltage Vss 210. Output PMOS transistor M9 is caused to be turned on and pulls Vout 208 to Vdd 108. Thus, in bypass mode, output voltage Vout 208 is driven to maximum supply voltage Vdd 108, effectively causing output PMOS transistor M9 to behave as a power or block head switch (BHS) similar to transistors of BHS 106*a-d* of FIG. 1.

LDO 104*x* suffers from unintended consequences or non-idealities in some cases. For example, turning off LDO 104*x* (e.g., when off 204 is high and bypass 206 is low) or placing LDO 104*x* in bypass mode (e.g., when bypass 206 is high) causes a disparity in the gate voltages of NMOS transistors M1 and M2. This is because when bypass 206 is high in the bypass mode, Vdd 108 is effectively shorted to Vout 208, which causes the gate terminal of NMOS transistor M2 (connected to Vout 208), to be shorted to Vdd 108 in the bypass mode. However, the gate terminal of NMOS transistor M1 remains connected to Vref 202, where reference voltage Vref 202 may be different from maximum supply voltage Vdd 108. In operating conditions, cores 104*a-d* can be turned off or placed in bypass mode for significant lengths of time. This means that disparate voltages Vref 202 and Vdd 108 can appear at the gates of the input transistors M1 and M2 of differential amplifier 200 of LDO 104*x*, for significant lengths of time (while the source voltages of NMOS transistors M1 and M2, coupled to current source 218, remain the same). The disparate voltages can lead to limitations in analog performance characteristics of LDO 104*x*, for example, where the various transistors (NMOS/PMOS) of LDO 104*x* can be formed in deep submicron complementary metal oxide semiconductor (CMOS) technology as seen in modern microprocessor/integrated circuit designs.

The disparate gate voltages appearing on NMOS transistors M1 and M2 (while their source voltages are equal) can cause different levels of hot electron injection into gate oxides which form the gate terminals of NMOS transistors M1 and M2. The different levels of hot electron injection into gate oxides of NMOS transistors M1 and M2 can cause an offset voltage to appear between NMOS transistors M1 and M2 (e.g., Vout 208 deviates from Vref 202). In other words, device characteristics of NMOS transistors M1 and M2 may deviate from one another in an undesirable manner.

Figure 1:
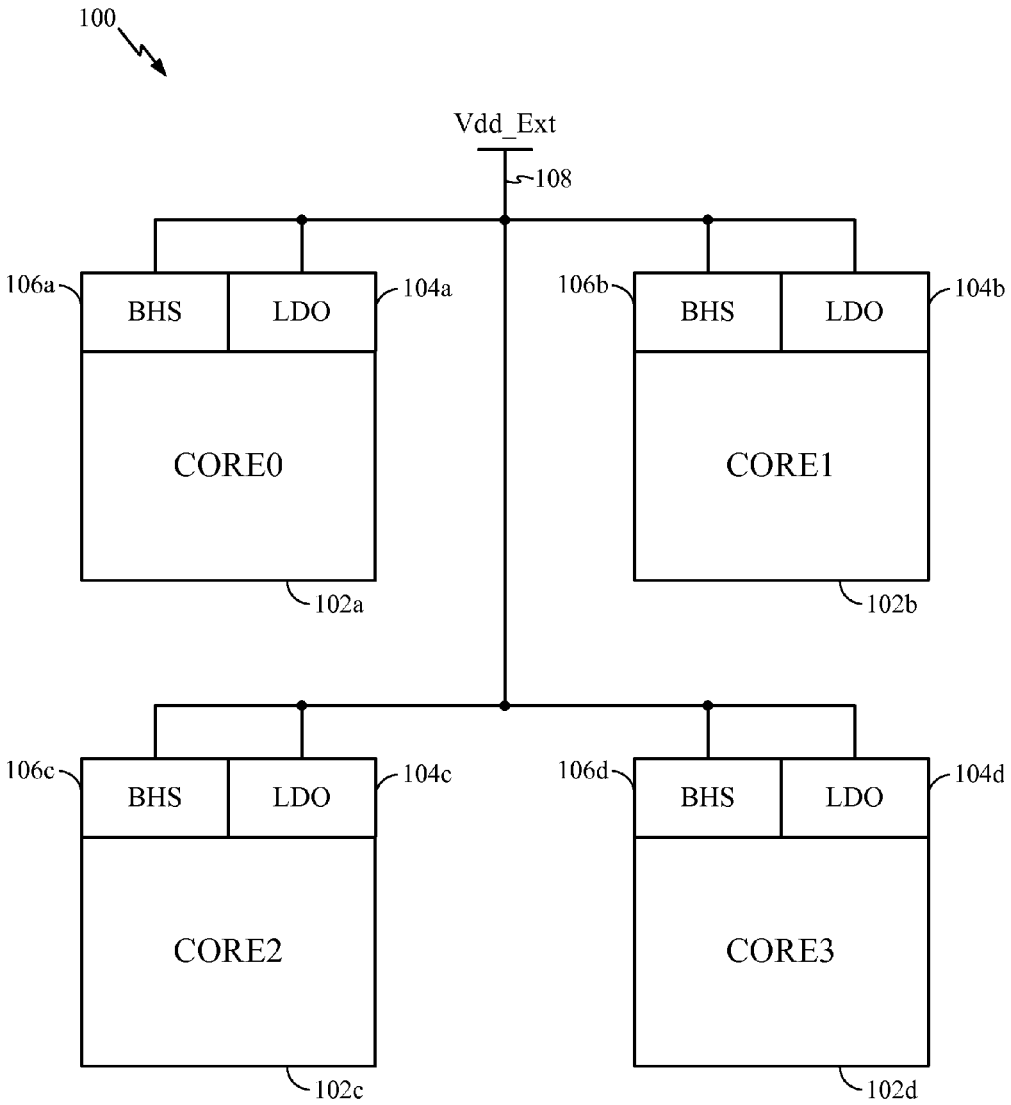
FIG. 1 illustrates a conventional multi-core processing system comprising two or more cores and corresponding LDO voltage regulators.

In some designs, two or more LDOs can be placed in the perimeter of at least one of the cores, e.g., a first core, of processing system 100 of FIG. 1 (e.g., for providing different voltages to different subsystems of the first core). Under ideal operating conditions, the two or more LDOs may be expected to perform in a substantially identical manner and provide substantially the same values of regulated voltage (e.g., Vout 208) to the first core when the two or more LDOs are active. However, if offset voltages are created in the two or more LDOs during their times spent in bypass mode or being turned off (where there can be variation in the amount of time each LDO is placed in bypass/off mode) the offset voltages created in each LDO can vary, sometimes significantly. With different offset voltages in the two or more LDOs, disparities can arise in the current provided to corresponding subsystems. LDOs whose offset voltages cause them to drift to higher output voltages may provide larger proportions of the total load current. If significant drifts are created between the two or more LDOs provided for the first core, subsystems coupled to the LDOs whose output voltages drift to lower values are provided with lower current and these subsystems can get starved for load current, reducing their abilities to respond rapidly to load current changes. Therefore the disparities degrade the performance of the two or more LDOs provided for the first core.

Figure 3:
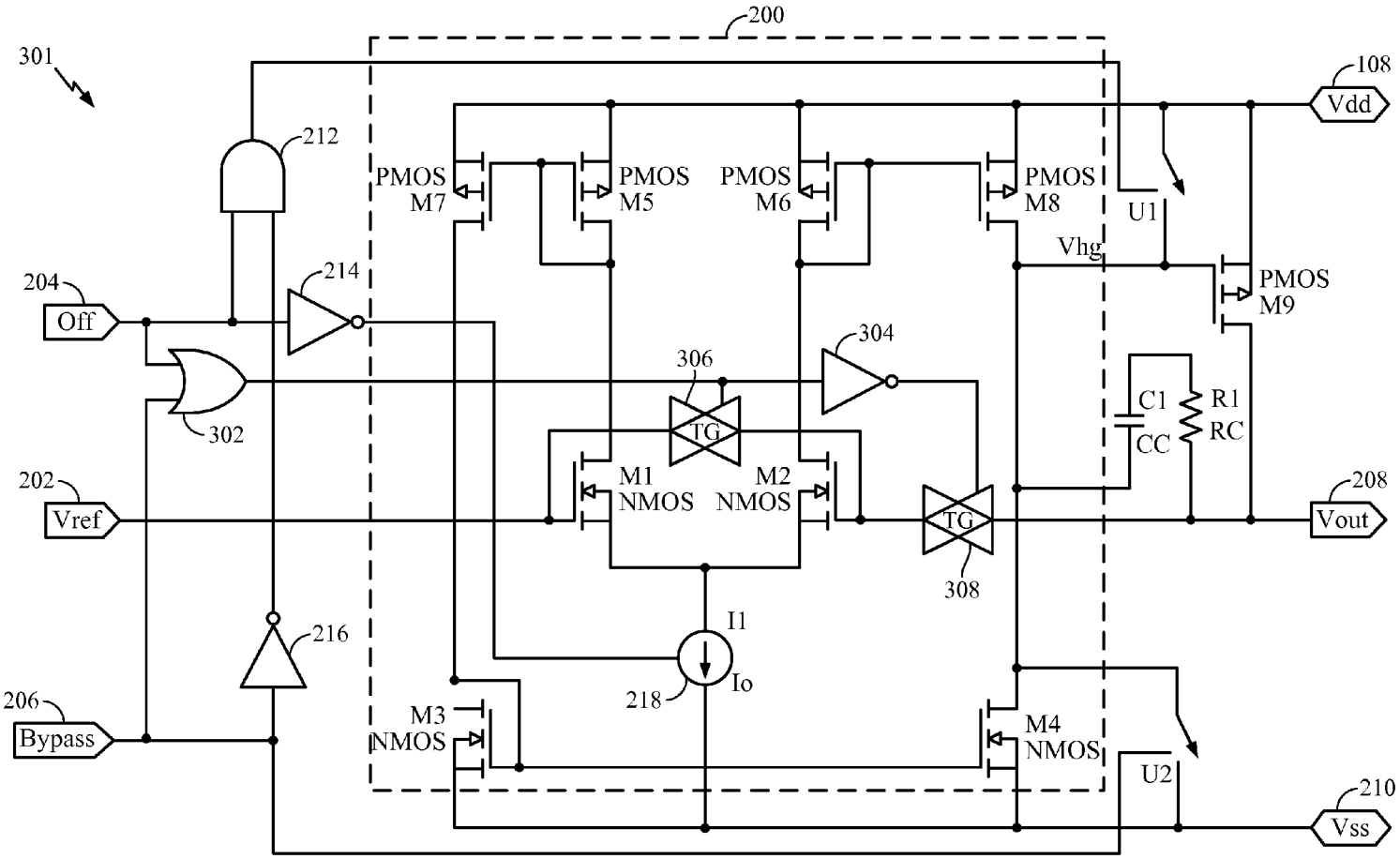
FIG. 3 an exemplary LDO voltage regulator.

Exemplary LDOs described below are designed to mitigate the aforementioned problems in conventional systems. With reference now to FIG. 3, exemplary LDO voltage regulator (or simply, "LDO") 301 is illustrated. LDO 301 can replace conventional LDOs such as LDOs 104*a-d*, for example, in processing system 100 in some aspects. Exemplary LDO 301 of FIG. 3 has some similarities with conventional LDO 104*x* of FIG. 2, and so like reference numerals have been retained to designate similar components with similar functionalities between LDOs 104*x* and 301. A repetition of the similar components will be avoided for the sake of brevity. Instead, a discussion of significant differences between conventional LDO 104*x* and exemplary LDO 301 will be undertaken to highlight exemplary features of this disclosure.

Accordingly, a significant difference in LDO 301 is seen in life extension or life enhancement circuitry and related techniques provided for LDO 301. The life enhancement circuitry includes OR gate 302, inverter 304, switches such as pass gates/transmission gates (TGs) 306 and 308, and related connections. The pass gates or TGs 306 and 308 may function as first and second switches, which, when turned on or closed, form a short circuit or conductor and when turned off or opened, form an open circuit which does not conduct current. In some aspects, the first and second switches may be designed using NMOS or PMOS transistors, rather than a transmission gate, as illustrated.

The life enhancement circuitry is configured to protect LDO 301 from undesirable effects which can arise when LDO 301 is turned off or placed in bypass mode. Effectively, when LDO 301 is turned off (or placed in an "off" state) or bypassed (or placed in bypass mode) first and second TGs 306 and 308, respectively, are configured to selectively disconnect the gate terminal of NMOS transistor M2 from output voltage Vout 208, and instead connect the gate terminal of NMOS transistor M2 to the gate terminal of NMOS transistor M1, such that the gate terminals of both input devices NMOS transistors M1 and M2 of differential amplifier 200 are at the same voltage or potential when LDO 301 is turned off or placed in bypass mode.

In further detail, when LDO 301 is not active, i.e., when off 204 is high (i.e., LDO 301 is turned off) or when bypass 206 is high (i.e., LDO 301 is placed in bypass mode), the output of OR gate 302 is high, which causes the first switch or first TG 306 to be turned on, causing the gate terminal (or simply, "gate") of the first input transistor or NMOS transistor M1 and the gate of the second input transistor or NMOS transistor M2 to be selectively coupled to each other. Further, the output of inverter 304 is low, which causes the second switch or second TG 308 to be turned off, causing the gate terminal of NMOS transistor M2 to be decoupled or disconnected from Vout 208.

On the other hand, when LDO 301 is in normal operation or in active mode (e.g., to supply a regulated output voltage Vout 208, lower than maximum supply voltage Vdd 108 to corresponding cores 104*a-d*), off 204 and bypass 206 are low. This causes the output of OR gate 302 to be low, turning off the first switch or first TG 306 and decoupling or disconnecting the gates of the first and second input transistors or NMOS transistors M1 and M2. Further, the output of inverter 304 would be high, causing second TG 308 to be turned on, to connect the gate terminal of NMOS transistor M2 to Vout 208. Thus, LDO 301 is placed in the normal operation mode where differential amplifier 200 causes Vout 208 to be equal to Vref 202, and thus, undesirable voltage offsets between Vout 208 and Vref 202 will not arise over extended periods of operation.

As previously described, in bypass mode or in off mode, the second TG 308 will be turned off, disconnecting Vout 208 from the gate terminal of NMOS transistor M2, while first TG 306 will be turned on, shorting both inputs of differential amplifier 200, thus eliminating voltage differentials regardless of whether Vout 208 is pulled low or high.

It will be recognized that the threshold voltages (Vth) of NMOS transistors M1 and M2 can develop minor variations over long periods of operation, for example, based on particular values of Vref 202. However, even if the threshold voltages of NMOS transistors M1 and M2 are different, since their gate terminals are shorted, the differences in threshold voltages may not be significant, and moreover, any insignificant differences in threshold voltages may not cause significant offset voltages to arise. Thus, the life of LDO 301 will be extended.

In an alternative implementation of LDO 301 (not shown), rather than using first and second TGs 306 and 308, a first switch (e.g., similar to first TG 306) can be used to connect the gate terminals of the first and second input transistors M1 and M2, and a different second switch (which replaces TG 308) can be used to disconnect or decouple the gate terminal of first input transistor M1 from reference voltage (e.g., Vref 202) when the LDO is not active (i.e., the LDO is in off or bypass modes). Correspondingly, the different second switch can couple the gate terminal of first input transistor M1 to the reference voltage when the LDO is active.

It will be understood that the above exemplary techniques for extending life of LDO voltage regulators can be extended to any circuit comprising an operational amplifier or differential amplifier whose gate voltages of complementary input transistors (e.g., NMOS transistors M1 and M2) may be driven to and maintained at different potentials/voltages for long periods of times, causing different levels of hot electron build up, offset voltages, etc., as explained in the case of LDO voltage regulators.

Figure 4:
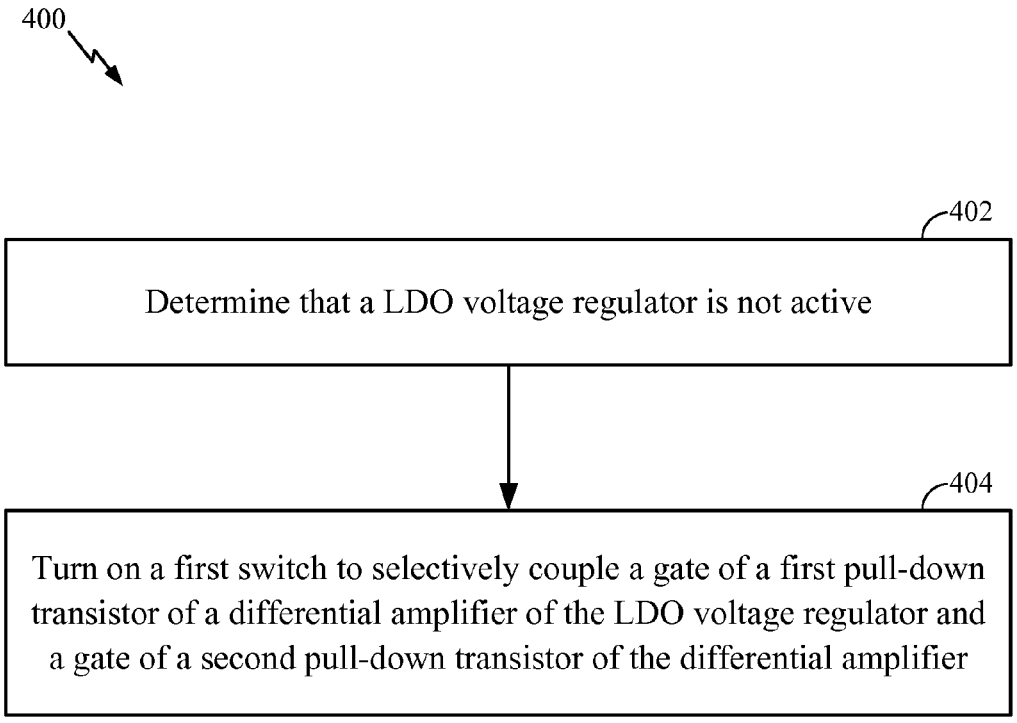
FIG. 4 illustrates a flow chart pertaining to a method for extending life of an LDO voltage regulator.

Accordingly, it will be appreciated that exemplary aspects include various methods for performing the processes, functions and/or algorithms disclosed herein. For example, FIG. 4 illustrates method 400 of extending life of a low-dropout (LDO) voltage regulator (e.g., LDO 301). Method 400 can include the following aspects.

In Block 402, method 400 includes determining that the LDO voltage regulator is not active (e.g., LDO 301 is turned off or is in bypass mode).

In Block 404, method 400 includes turning on a first switch (e.g., first TG 306) to selectively couple a gate of a first input transistor (e.g., NMOS transistor M1) of an differential amplifier (e.g. differential amplifier 200) of the LDO voltage regulator and a gate of a second input transistor (e.g., NMOS transistor M2) of the differential amplifier, when the LDO voltage regulator is not active.

In further aspects, method 400 can also include turning on a second switch (e.g., second TG 308) to decouple the gate of the second input transistor from an output voltage (e.g., Vout 208) of the LDO voltage regulator when the LDO voltage regulator is not active; and turning off the second switch to selectively couple the gate of the second input transistor to the output voltage of the LDO voltage regulator when the LDO voltage regulator is active.

In exemplary aspects, an LDO voltage regulator (e.g., LDO 301) comprising a differential amplifier (e.g., differential amplifier 200) can comprise means for amplifying, wherein a first input transistor (e.g., NMOS transistor MD and a second input transistor (e.g., NMOS transistor M2) can comprise corresponding first and second input transistors of the means for amplifying. The above-described first and second switches (e.g., TG 306 and TG 308) can comprise means for performing functions related to coupling or decoupling according to exemplary aspects discussed herein.

Figure 5:
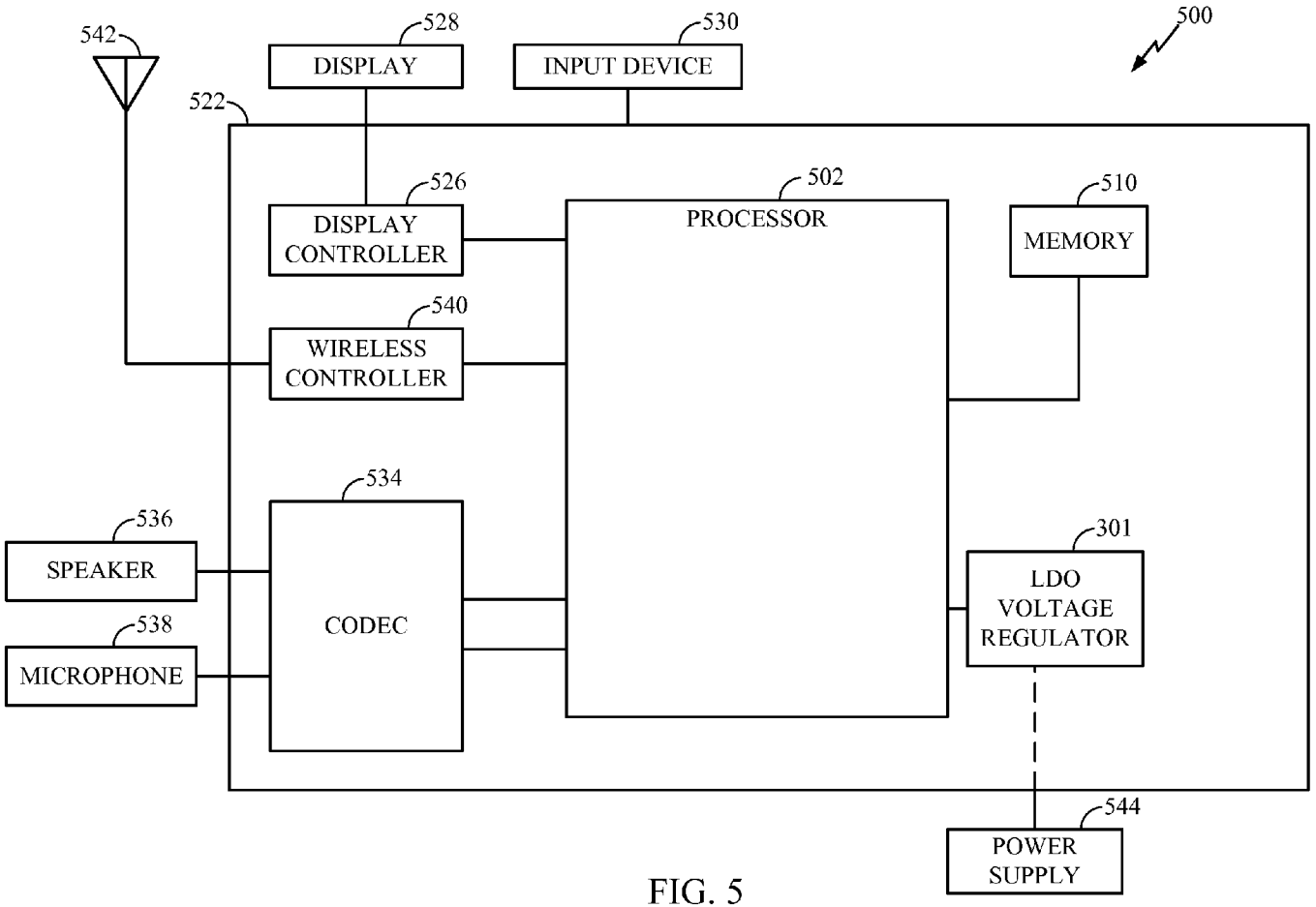
FIG. 5 illustrates an exemplary processing device in which an aspect of the disclosure may be advantageously employed.

An example apparatus in which the exemplary LDO 301 may be deployed will now be discussed in relation to FIG. 5. FIG. 5 shows a block diagram of processing device 500 that is configured according to exemplary aspects. Processing device 500 may be a wireless device in some aspects. Further, processing device 500 may be configured to implement method 400 of FIG. 4 in some aspects. As shown, processing device 500 includes processor 502, which may be a processing core such as cores 102*a-d* of system 100. In FIG. 5, LDO 301 (e.g., as shown in FIG. 3) may be coupled to processor 502. LDO 301 may derive power from power supply 544 (e.g., positive supply voltage Vdd 108) and provide regulated voltage to processor 502. More than one LDO such as LDO 301 may be provided in some cases (e.g. around the perimeter of processor 502) to supply power to various subsystems of processor 502.

To describe processing device 500 in further detail, processor 502 may be communicatively coupled to memory 510. FIG. 5 also shows display controller 526 that is coupled to processor 502 and to display 528. Coder/decoder (CODEC) 534 (e.g., an audio and/or voice CODEC) can be coupled to processor 502. Other components, such as wireless controller 540 (which may include a modem) are also illustrated. Speaker 536 and microphone 538 can be coupled to CODEC 534. FIG. 5 also indicates that wireless controller 540 can be coupled to wireless antenna 542. In a particular aspect, processor 502, display controller 526, memory 510, CODEC 534, and wireless controller 540 are included in a system-in-package or system-on-chip device 522. In some aspects, one or more LDOs such as LDO 301 may also be provided to supply regulated voltage to one or more of display controller 526, memory 510, CODEC 534, and wireless controller 540 of system-on-chip device 522.

In a particular aspect, input device 530 and power supply 544 are coupled to the system-on-chip device 522. Moreover, in a particular aspect, as illustrated in FIG. 5, display 528, input device 530, speaker 536, microphone 538, wireless antenna 542, and power supply 544 are external to the system-on-chip device 522. However, each of display 528, input device 530, speaker 536, microphone 538, wireless antenna 542, and power supply 544 can be coupled to a component of the system-on-chip device 522, such as an interface or a controller.

It should be noted that although FIG. 5 depicts a wireless communications device, processor 502 and memory 510, may also be integrated into a set-top box, a music player, a video player, an entertainment unit, a navigation device, a personal digital assistant (PDA), a fixed location data unit, a computer, a laptop, a tablet, a mobile phone, or other similar devices.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The methods, sequences and/or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

Accordingly, an aspect of the invention can include a computer readable media embodying a method for extending lifespan of a LDO voltage regulator. Accordingly, the invention is not limited to illustrated examples and any means for performing the functionality described herein are included in aspects of the invention.

While the foregoing disclosure shows illustrative aspects of the invention, it should be noted that various changes and modifications could be made herein without departing from the scope of the invention as defined by the appended claims. The functions, steps and/or actions of the method claims in accordance with the aspects of the invention described herein need not be performed in any particular order. Furthermore, although elements of the invention may be described or claimed in the singular, the plural is contemplated unless limitation to the singular is explicitly stated.

What is claimed is:

1. A low-dropout (LDO) voltage regulator comprising:

a differential amplifier comprising a first input transistor and a second input transistor;

a first switch to selectively couple a gate of the first input transistor and a gate of the second input transistor when the LDO voltage regulator is not active; and a second switch to decouple the gate of the second input transistor from an output voltage of the LDO voltage regulator when the LDO voltage regulator is not active, and directly connect the gate of the second input transistor to the output voltage of the LDO voltage regulator when the LDO voltage regulator is active.

2. The LDO voltage regulator of claim 1, wherein the first switch is further configured to decouple the gate of the first input transistor from the gate of the second input transistor when the LDO voltage regulator is active.

3. The LDO voltage regulator of claim 1, wherein the first switch and the second switch comprise a first transmission gate and a second transmission gate, respectively.

4. The LDO voltage regulator of claim 1, wherein the LDO voltage regulator is bypassed or turned off when the LDO voltage regulator is not active.

5. The LDO voltage regulator of claim 1, wherein the gate of the first input transistor is coupled to a reference voltage.

6. The LDO voltage regulator of claim 1, wherein threshold voltages of the first and second input transistors are substantially equal when the LDO voltage regulator is not active.

7. A method of extending life of a low-dropout (LDO) voltage regulator, the method comprising:

turning on a first switch to selectively couple a gate of a first input transistor of a differential amplifier of the LDO voltage regulator and a gate of a second input transistor of the differential amplifier, when the LDO voltage regulator is not active;

turning off a second switch to decouple the gate of the second input transistor from an output voltage of the LDO voltage regulator when the LDO voltage regulator is not active; and turning on the second switch to directly connect the gate of the second input transistor to the output voltage of the LDO voltage regulator when the LDO voltage regulator is active.

8. The method of claim 7, further comprising turning off the first switch to decouple the gate of the first input transistor from the gate of the second input transistor when the LDO voltage regulator is active.

9. The method of claim 7, comprising bypassing or turning off the LDO voltage regulator when the LDO voltage regulator is not active.

10. The method of claim 7, comprising coupling the gate of the first input transistor to a reference voltage.

11. The method of claim 7, wherein threshold voltages of the first and second input transistors are substantially equal when the LDO voltage regulator is not active.

12. An apparatus comprising:

means for amplifying;

means for selectively coupling a gate of a first input transistor of the means for amplifying and a gate of a second input transistor of the means for amplifying, when the apparatus is not active;

means for decoupling the gate of the second input transistor from an output voltage of the apparatus when the apparatus is not active; and means for directly connecting the gate of the second input transistor to the output voltage of the apparatus when the apparatus is active.

* * * * *